2-171.3 S4
10/15/85 OR 4,546,496

United States Patent [19]

Lewis

[11] Patent Number: 4,546,496

[45] Date of Patent: Oct. 15, 1985

[54] HAT MOUNTED VENTILATION APPARATUS

[76] Inventor: Willie Lewis, 1019 W. 106th St., Los Angeles, Calif. 90044

[21] Appl. No.: 619,590

[22] Filed: Jun. 11, 1984

[51] Int. Cl.[4] ..... A61F 9/06

[52] U.S. Cl. ..... 2/171.3; 2/436; 2/437

[58] Field of Search ..... 2/171.3, 436, 437

[56] References Cited

U.S. PATENT DOCUMENTS

| | | | |
|---|---|---|---|
| 3,168,748 | 2/1965 | Limberg | 2/171.3 |
| 3,391,407 | 7/1968 | Waters | 2/171.3 |
| 3,825,953 | 7/1974 | Hunter | 2/437 |
| 4,238,857 | 12/1980 | Waters | 2/171.3 |
| 4,309,774 | 1/1982 | Guzowski | 2/171.3 X |
| 4,443,893 | 4/1984 | Yamamoto | 2/436 |

*Primary Examiner*—Louis K. Rimrodt
*Attorney, Agent, or Firm*—Michael A. Painter

[57] ABSTRACT

The present invention comprises a portable ventilation system which can be incorporated into caps, hats or other conventional headgear. An aperture is formed in the brim or front section of a hat or cap which is adapted to receive the body of the ventilating apparatus. A direct current motor is installed at the center of the mounted body, the shaft of the motor being directly coupled to a multiple bladed impeller. A directional visor is mounted below the impeller and in juxtaposition to the user's face for directing the flow of air resulting from rotation of the impeller. The DC motor is powered by a portable battery pack. Interconnection between the motor source for the present invention and the battery pack allows the hat or cap upon which the present invention is mounted to be removed.

2 Claims, 4 Drawing Figures

HAT MOUNTED VENTILATION APPARATUS

BACKGROUND OF THE INVENTION

1. Field of the Invention

The present invention generally relates to ventilating apparatus, and more particularly, to those devices which can be removeable affixed to a moving user.

2. Prior Art

The prior art discloses numerous devices which can be used to provide a flow of air toward the face of the user or to cause the air flow to clear the vicinity of the user's eyes, etc. of particulate matter or other airborne particles which would otherwise obscure the vision of the user. The typical device disclosed by the prior art requires the use of a device which is remote from the user and which is restricted either to a given area or to some defined volume which is controlled by the device itself. Space cooling units or other conventional fans are typical of this class of devices. The inadequacies of these devices are obvious. Since the ventilating function of the devices is limited to a fixed area, any movement of the user could result in the total loss of cooling, ventilating or extraction of particulate matter in the vicinity of the user. The present invention resolves this problem by providing means whereby the ventilating unit can be carried by the user irrespective of location.

Another class of devices disclosed by the prior art are generally applied in industrial applications. Where individuals are required to work in locations where the air may contain smoke or other particulate matter which would obscure vision, sophisticated devices generally provide movement of the air away from the user, these devices generally employing conventional masks and filters. Despite permitting the device to be moved with the user, there are inherent problems. Since these devices are generally employed in industrial applications, they cannot be employed for cooling purposes as opposed to air extraction. In addition, because they are generally associated with sophisticated masks and filters, they are permanently mounted to a single head covering. The present invention substantially resolves this problem. The present invention can be moved from one head covering to another, the only requirement being that the covering have means for receiving the outer frame of the ventilating unit. In addition, the present invention can be employed in both ventilating and cooling applications by reversing the rotation of the impeller shaft.

SUMMARY OF THE INVENTION

The present invention comprises a substantially cylindrical frame at the center of which is mounted a direct current motor for driving a multibladed impeller. The direct current motor is adapted to be removeably connected to a portable battery source. A flange having a larger diameter than the body is mounted at the lower terminus of the cylindrical body and adapted to be inserted upwardly into a receiving aperture of a hat brim or cap. A securing flange disposed about the frame frictionally secures the body in place. A grate or obstructing grill is secured below the impeller to preclude the user from inadvertently contacting the impeller while it is in motion. A dual directional visor is secured below the flange and about the circumference of the cylindrical body to provide adjustable direction to the air flow.

It is therefore an object of the present invention to provide an improved ventilating device for attachment to head gear.

It is another object of the present invention to provide a portable ventilating device for attachment to head gear having means for adjusting the flow of air.

It is still another object of the present invention to provide a ventilating device which is secured on a nonpermanent basis to head gear.

It is still yet another object of the present invention to provide an improved ventilating device for head gear which is simple and inexpensive to fabricate.

The novel features which are believed to be characteristic of the invention, both as to its organization and method of operation, together with further objectives and advantages thereof, will be better understood from the following description considered in connection with the accompanying drawing in which a presently preferred embodiment of the invention is illustrated by way of example. It is to be understood, however, that the drawing is for the purpose of illustration and description only and is not intended as a definition of the limits of the invention.

DESCRIPTION OF THE PRESENTLY PREFERRED EMBODIMENT

Figure 1:
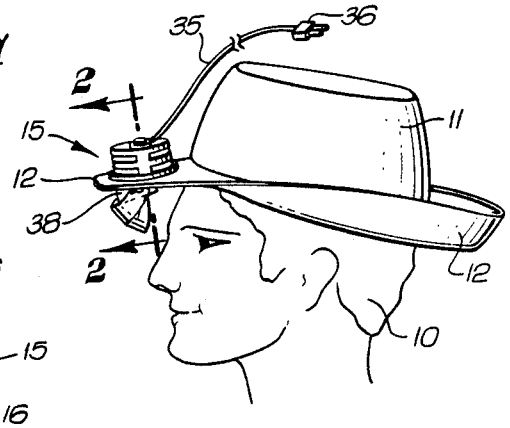
FIG. 1 is a perspective view showing the present invention ventilating apparatus mounted upon exemplary head gear.
Figure 2:
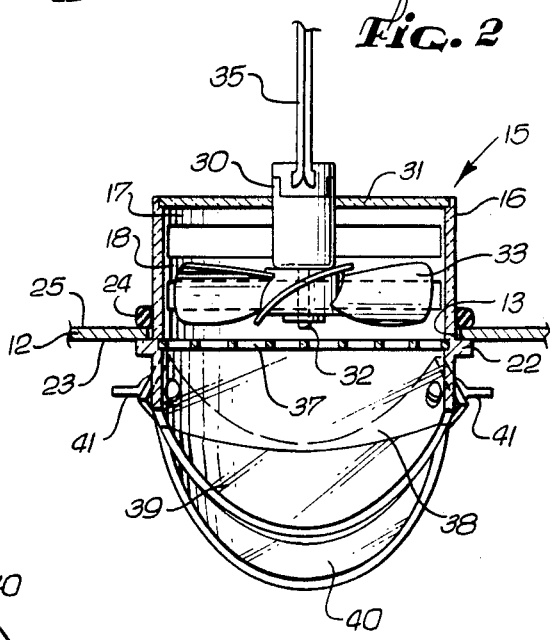
FIG. 2 is a side elevation, cross-sectional view of the mounted ventilating apparatus shown in FIG. 1 taken through line 2—2 of FIG. 1.

The use of the present invention can be best understood by reference to FIG. 1. As shown in FIG. 1, a user 10 is shown having mounted upon his head conventional head gear in the form of a hat 11. It is to be understood that although the illustration of the use of the present invention is shown with head gear such as the hat 11 shown in FIG. 1, the present invention is equally usable with caps, industrial headwear or other similar devices. As can be best seen from FIG. 1 and FIG. 2, the hat 11 empoys a brim 12. The forward portion of the brim 12 adjacent the user's face has an aperture 13 disposed therein for the purpose of receiving the body of the present invention ventilating apparatus generally designated by the reference numeral 15. As stated previously, although a conventional hat 11 has been used for the purpose of explaining the use of the present invention, an aperture such as that designated by the reference numeral 13 can be formed in the bill of a cap or front of a working helmet, the only requirement being that it be adapted to appropriately receive ventilating apparatus 15.

Figure 3:
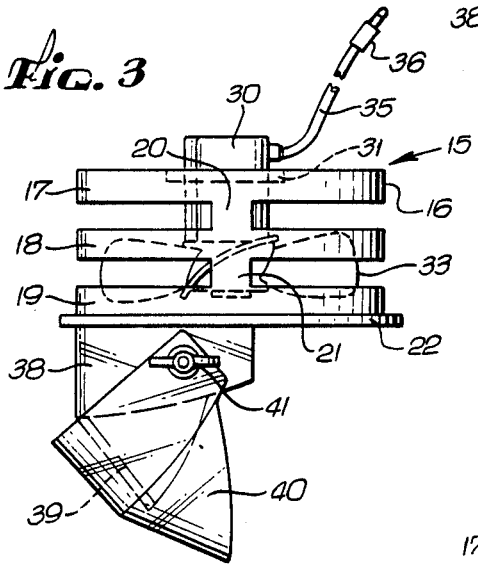
FIG. 3 is a side elevation view of the present invention.
Figure 4:
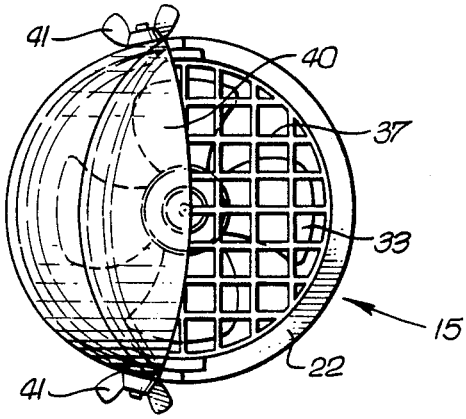
FIG. 4 is a bottom plan view of the present invention ventilating apparatus.

As can be seen in FIG. 3 and FIG. 4, ventilating apparatus 14 has a substantially cylindrical body 16 which is preferably constructed of molded plastic. The axial dimension of body 16 comprises a series of axially aligned members 17, 18 and 19 which are coupled together along their circumference at several locations 20 and 21. The openings between axially aligned members 17 and 18, and 18 and 19 respectively, provide for increased air flow. A flange 22 depends from the bottom edge of axially aligned member 19, the circumference of flange 22 being substantially greater than that of aligned members 17, 18 and 19. As can be seen best in FIG. 2, when the body 16 of the present invention is inserted upwardly through aperture 13 in brim 12, flange 22 properly seats against the lower surface 23 of brim 12. Since there are no radial obstructions in the outer surface of aligned members 17, 18 and 19, frictionally resilient member 24 (FIG. 2) is disposed about the outer surface of body 16 in a manner which forces flange 22 against the bottom surface 23 of brim 12, the resilient, frictional member 24 being disposed about the top surface 25 of brim 12. The frictional, resilient member can be implemented through the use of a conventional rubber O-ring or washer which is fabricated of flexible material having a substantially frictional surface.

A direct current motor 30 is axially mounted within body 16, motor 30 being suspended from supporting mount 31. Supporting mount 31 is coupled along the diameter of body 16 at aligned member 17. Motor 13 has a rotating shaft 32 to which a multiple blade impeller 33 is affixed. Power for motor 30 is supplied by a pair of electrical conductors 35 which are electrically connected to an appropriate switching unit 36. Since it is an objective of the present invention to provide for air movement in either axial direction with respect to impeller 33, the polarity of connector 36 is preferably one which can be altered. As an alternative, conventional shaft gearing can be employed to change the direction of shaft 32 and thereby change the direction of air flow caused by impeller 33. Connector 36 is connected to a conventional battery pack which will thereby permit the user 10 to remove his hat or other head gear.

In operation, impeller 33 will be rotating in either a clockwise or counterclockwise direction, depending upon the selected direction of air movement. Since the impeller 33 will be rotating in an area near the face and hands of user 10, grid 37 is coupled to lower member 19 and substantially adjacent flange 22. The spacing of grid 37 will prevent inadvertent contact with blades of impeller 33.

A primary objective of the present invention is to permit the user to adjustably deflect air flow. A substantially semicircular fixed deflector 38 is permanently affixed to the bottom terminus of member 19. Since it is clear that impeller 33 will be limited with respect to the velocity of air flow which it can control, secondary deflection member 39 is affixed to and depends inwardly from the semicircular deflection member 38 forming an obtuse angle therewith. In the event that the head gear being employed places the present invention in the vicinity of the user's eyes, deflection members 38 and 39 will be manufactured of a transparent plastic such as lucite. To further provide control over the direction of the ventilating air flow, adjustable deflection screen 40 is adjustably mounted to primary deflection member 38 through the use of conventional couplings such as the bolt and wing nut 41 illustrated in the drawing. The user 10 can rotate deflection screen 40 to any position within the air stream thereby providing improved ventilating capability.

It can therefore be seen that the present invention constitutes a substantial improvement over personal ventilating apparatus. The present invention can be moved from one piece of head gear to another subject only to a requirement that an aperture be provided for receiving the body 16 of the ventilating apparatus. The present invention provides for reversal of air flow to remove particulate matter from the vicinity of the face of the user 10 as well as providing for direct ventilating control through the use of deflector members 38 and 39 and deflection screen 40.

I claim:

1. A ventilating apparatus for mounting upon head gear comprising:

(a) a cylindrical body having upper and lower ends;

(b) a circular flange secured to the lower end of said cylindrical body about the axis of said cylindrical body, said flange having a circumference which is larger than that of said cylindrical body;

(c) frictional securing means disposed about the outer surface of the cylindrical body for securing the head gear adjacent said circular flange;

(d) a rotary power source coupled to the cylindrical body along the axis thereof;

(e) a multiple bladed impeller coupled to the rotary power source and adapted to rotate about the axis of the cylindrical body;

(f) direct current power means coupled to the rotary power source;

(g) a first semicircular deflection member having a radius which is substantially equal to that of the cylindrical body, said first deflection member depending downwardly from the lower end of the cylindrical body;

(h) a second deflection member integral with the first deflection member opposite the cylindrical body, said second deflection member being disposed at an obtuse angle with respect to the first deflection member; and (i) a third deflection member pivotally coupled to said first deflection member, said third deflection member being adapted to adjustably deflect the axial flow of air from said multiple bladed impeller.

2. A ventilating apparatus as defined in claim 1 including a circular grid secured to the lower end of the cylindrical body adjacent said circular flange and being intermediate the first deflection member and the multiple bladed impeller.

* * * * *